US006758159B2

(12) United States Patent
McCudden et al.

(10) Patent No.: US 6,758,159 B2
(45) Date of Patent: Jul. 6, 2004

(54) APPARATUS FOR SUPPORTING FLAGS, BANNERS AND THE LIKE

(76) Inventors: Arthur Lachlan McCudden, 141 Lucinda Avenue, Wahroonga, New South Wales, 2076 (AU); Lachlan Arthur Dean McCudden, 50A Wall Avenue, Asquith, New South Wales, 2077 (AU)

( * ) Notice: Subject to any disclaimer, the term of this patent is extended or adjusted under 35 U.S.C. 154(b) by 0 days.

(21) Appl. No.: 10/139,848

(22) Filed: May 7, 2002

(65) Prior Publication Data

US 2003/0010274 A1 Jan. 16, 2003

(30) Foreign Application Priority Data

May 8, 2001 (AU) ..... PR4823

(51) Int. Cl.[7] ..... G09F 17/00

(52) U.S. Cl. ..... 116/173; 116/174; 248/329; 248/334.1; 52/111

(58) Field of Search ..... 116/173–174; 248/329, 334.1, 333, 218.4; 52/111, 123.1; 212/281

(56) References Cited

U.S. PATENT DOCUMENTS

| | | | | | |
|---|---|---|---|---|---|
| 685,856 | A | * | 11/1901 | Menuez | 248/334.1 |
| 1,645,645 | A | * | 10/1927 | Davis | 116/173 |
| 2,327,056 | A | * | 8/1943 | Nelson | 116/173 |
| 2,630,779 | A | * | 3/1953 | Mader | 116/173 |
| 3,418,967 | A | * | 12/1968 | Donkersloot | 116/173 |
| 3,675,615 | A | * | 7/1972 | Stangarone et al. | 116/173 |
| 5,329,873 | A | * | 7/1994 | Tiballi | 116/173 |

* cited by examiner

*Primary Examiner*—Diego Gutierrez
*Assistant Examiner*—Tania Courson
(74) *Attorney, Agent, or Firm*—Paul & Paul

(57) ABSTRACT

An apparatus (12) for supporting a flag comprising a housing (26) having an opening (24) in a side face. A passage (30) extends trough housing (26). The housing (28) has a lower tubular part (40) that is mounted to the top of a flagpole (10). A cable (16) is attached to an arm (14). The cable extends from a winch (22) up through the flagpole and through the passage (30) in the housing (26). The cable is attached to the arm (14). In order to attach a flag to arm (14), winch (22) is operated to extend cable (16) and to lower arm (14) to the ground. Once a flag is attached to arm (14), the winch (22) is operated to retract the cable (16). This draws the arm (14) into the housing (26). Continued retraction of the cable (16) results in the arm (14) adopting an essentially horizontal position. The apparatus may rotate.

28 Claims, 12 Drawing Sheets

APPARATUS FOR SUPPORTING FLAGS, BANNERS AND THE LIKE

FIELD OF THE INVENTION

The present invention relates to an apparatus for supporting flags, banners or the like. The apparatus may be mounted to the top of a flagpole or the like or it may form part of a flagpole or the like.

BACKGROUND OF THE INVENTION

Flagpoles are well known to all members of the community. The typical flagpole has an elongate pole extending vertically from the ground. A pulley is located at an upper end of the pole and a wire runs around the pulley. A flag is removably attached to the wire by personnel on the ground and the flag is then raised. Such flagpoles have a vertical edge of the flag attached to the wire, As a result, when conditions are not windy, the flag hangs limply against the pole.

In addition to hanging flags from flagpoles, it is becoming common to want to display advertising banners or commemorative banners from poles. With such banners it is especially undesirable to have the banner hang limply from the pole as the advertising or commemorative message is lost. In order to overcome this problem, poles may have horizontally extending arms fitted thereto such that the banner may hang from the horizontal arm. As the banner is suspended from a horizontal edge, it is fully displayed even in windless conditions.

Unfortunately, it can be difficult to hang banners or flags from such poles as the horizontal arms are typically fixed at the top of the pole or, if not at the top, quite some distance above the ground. In order to hang banners or flags on such poles, it is necessary to use ladders or cherry pickers to enable a person to reach the required height to hang the banner or flag. Alternatively, it is necessary to lower the pole to ground level. Either case is unsatisfactory in certain elements.

SUMMARY OF THE INVENTION

It is an objective the present invention to overcome or at least ameliorate some of the difficulties with the prior aft.

In a first aspect, the present invention provides an apparatus for supporting a flag, banner or the like comprising a housing having a passage therethrough, an arm, cable means attached to the arm and extending rough the passage wherein retracting the cable means through the housing causes the arm to be retracted into the housing and to be positioned in a predetermined orientation and releasing the cable means causes the arm to move from the predetermined orientation.

As used throughout the specification, the term "cable means" means extends to any cable, wire, rope or other generally filamentous material, irrespective of the particular construction thereof.

Preferably, releasing the cable means causes the arm to move out of the predetermined position under the influence of gravity.

The apparatus may further comprise mounting means for mounting the apparatus to a flagpole or the like. The mounting means may be used to mount the apparatus to the top of the flagpole or the like. The apparatus may be mounted to the top of the flagpole such that the apparatus can rotate.

The mounting means may suitably comprise a bush means having a flange at one end, the bush means being positioned such that it extends into a hollow part of a flagpole or the like and the flange rests on top of the flagpole, said bush means having an internal passage for receiving at least part of the housing.

Alternatively, the mounting means may comprise a bearing means affixed to a flagpole or the like, the bearing means supporting the housing.

In one particularly preferred embodiment, the passage in the housing includes an opening in a side face of the housing. This opening preferably has a lower edge and a wall of the passage extends upwardly and inwardly from the lower edge of the opening. In this fashion, the wall assists in guiding the arm to the desired predetermined orientation.

The arm preferably has a first shoulder positioned close to but away from an end thereof. When the arm is being retracted into the housing the shoulder may contact an engagement means to prevent fiber inward movement of the arm. Continued retraction of a cable means causes the arm to pivot upwardly about the engagement means into the predetermined position.

Preferably, the passage is shaped to allow the arm to pivot about the engagement means. In this regard, the passage may be shaped to provide clearance for movement of the portion of the arm that extends from the first shoulder to an inner end of the arm.

The first engagement means is suitably a first rod in the housing.

The arm preferably has a second shoulder opposed to the fist shoulder. In this embodiment, when the arm is in the predetermined orientation, the first and second shoulders may be positioned on opposite sides of the engagement means to thereby lock the arm against lateral movement when the arm is in the predetermined position.

In some instances, the opposed shoulders may be considered to define a neck region.

The housing may also include guide means around which the cable means can pass. The guide means is suitably a rotatable wheel, although a guide rod or arm may also be used.

The cable means should be sufficiently long to pass down the flagpole or the like and enable the arm to be lowered to essentially ground level. The banner or flag can then be attached to the arm and the cable means retracted to thereby raise the arm and position the arm on the predetermined position. To change a flag or banner, the cable means is unwound to thereby again lower the arm.

The predetermined orientation of the arm is generally horizontal. In some embodiments, the am may extend slightly upwardly and away from the housing when it is in the predetermined position. This assists in keeping the arm generally horizontal when the arm is carrying the weight of a flag, banner or the like.

In order to facilitate winding and unwinding of the cable means, a winch may be provided. The winch is suitably mounted within the flagpole for security purposes.

In another aspect, the present invention provides a flagpole or the like having an opening in a side surface thereof, a passageway extending from the opening and along the flagpole, an arm, a cable means attached to the arm, the cable means extending from the arm and through the passage wherein retraction of the cable means causes an end of the arm to move through the opening in the side surface of the flagpole or the like and to adopt a predetermined orientation and releasing the cable means causes the arm to move from the predetermined orientation.

In this aspect of the invention, the flagpole or the like may have a housing mounted therein. The housing may be generally similar to the housing as described with reference to the first aspect of the invention. Appropriate changes to the housing maybe made to account for the housing being mounted within the flagpole or the like.

Other features of the second aspect of the invention are suitably as described with reference to those features in the fist aspect of the invention.

The present invention also encompasses a flagpole or the like having the apparatus of the first aspect of the invention mounted thereto.

In embodiment where the apparatus can rotate about the flagpole or the like, the cable means is preferably provided with a swivel joint to avoid twisting of the cable means.

The arm may be suitably provided with means for attaching a flag or banner thereto. The arm may also be provided with fixing means to enable an extension arm to be fixed thereto. This will allow larger banners or flags to be suspended from the arm.

The predetermined orientation of the arm is preferably generally horizontal.

DETAILED DESCRIPTION OF THE DRAWINGS

It will be appreciated that the attached drawings are intended to illustrate a preferred embodiment of the present invention and the invention should not be considered to be limited to the embodiments shown therein.

Figure 1:
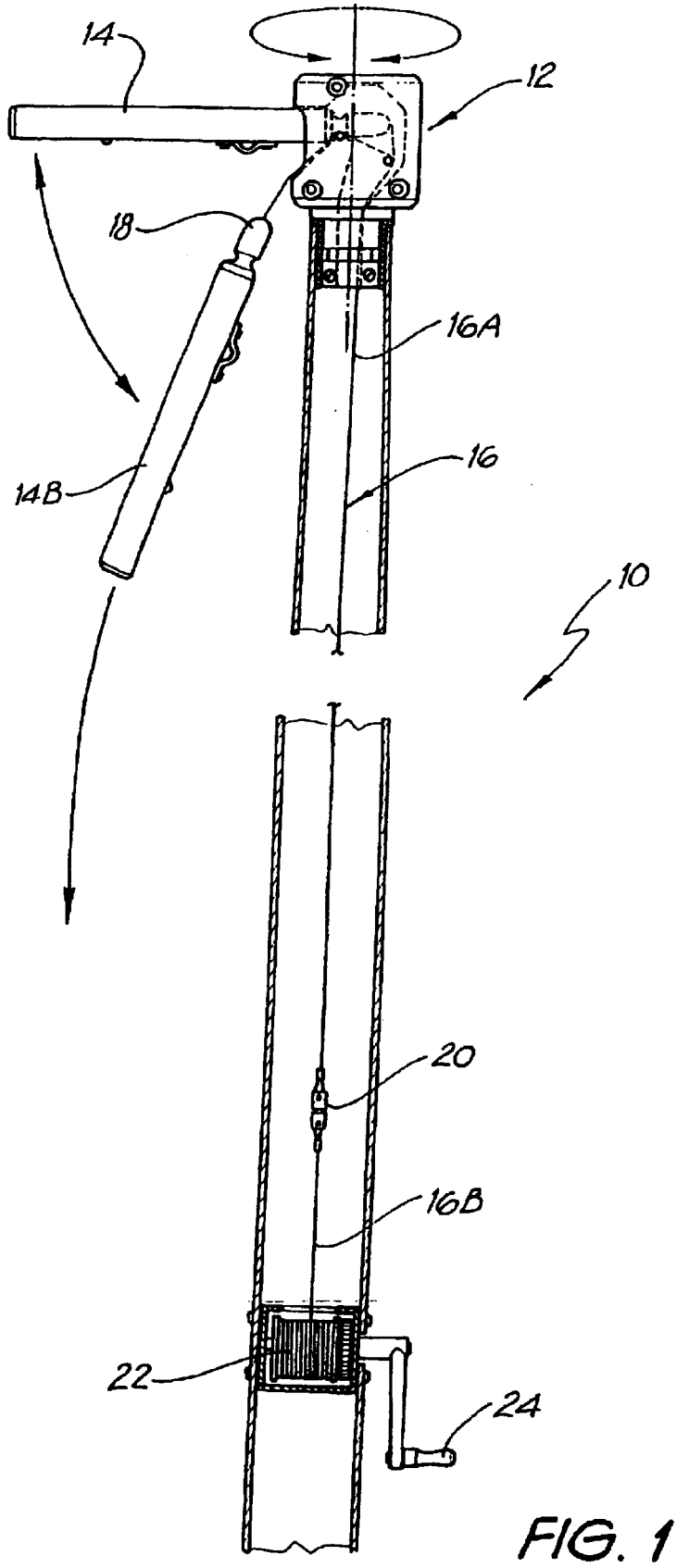
FIG. 1 shows a cross-sectional view of an apparatus in accordance with the present invention attached to the top of a flagpole.

Turing to FIG. 1, a hollow flagpole 10 is provided with the apparatus 12 in accordance with the invention. The apparatus 12 may be described as a rotating finial. The apparatus 12 will be described in more detail with reference to FIGS. 2 to 4 hereunder. Suffice to say that apparatus 12 is rotatably mounted to the top of hollow flagpole 10. The apparatus 12 includes an arm 14. A cable means, in the form of a cable 16 is attached to one end of arm 14. The cable 16 comprises an upper part 16A and a lower part 16B that are connected by a stainless steel swivel 20. The swivel is provided to ensure that the cable 16 will not become twisted should the rotatable finial 12 rotate about the axis of the flagpole 10 in use.

A winch 22 having a removable handle 24 is mounted to the inside of the flagpole 10. Winch 22 is used to unwind and wind up the cable 16.

In order to attach a flag, banner or the like to arm 14, the winch handle 24 is operated so that the cable 16 is unwound, which causes arm 14 to move from its upper position shown in FIG. 1 to a position adjacent or near the ground. The arm 14 moves via position 14 B as shown in FIG. 1. Once the arm has been positioned near the ground, a person can attach a flag or banner to the arm. The winch 22 is then wound up which causes cable 16 to lift the arm with attached flag or banner upwardly until the end 18 of arm 14 enters opening 24. Further winding of the winch causes the arm 14 to move to the essentially horizontal position shown in FIG. 1.

It will be appreciated that the above described manner of changing and fixing flags to the flagpole is much simpler than prior art methods which involved either putting a person up towards the top of the pole by a ladder or a cherry picker or dismantling or undoing the pole to lower it to essentially ground level.

Figure 2:
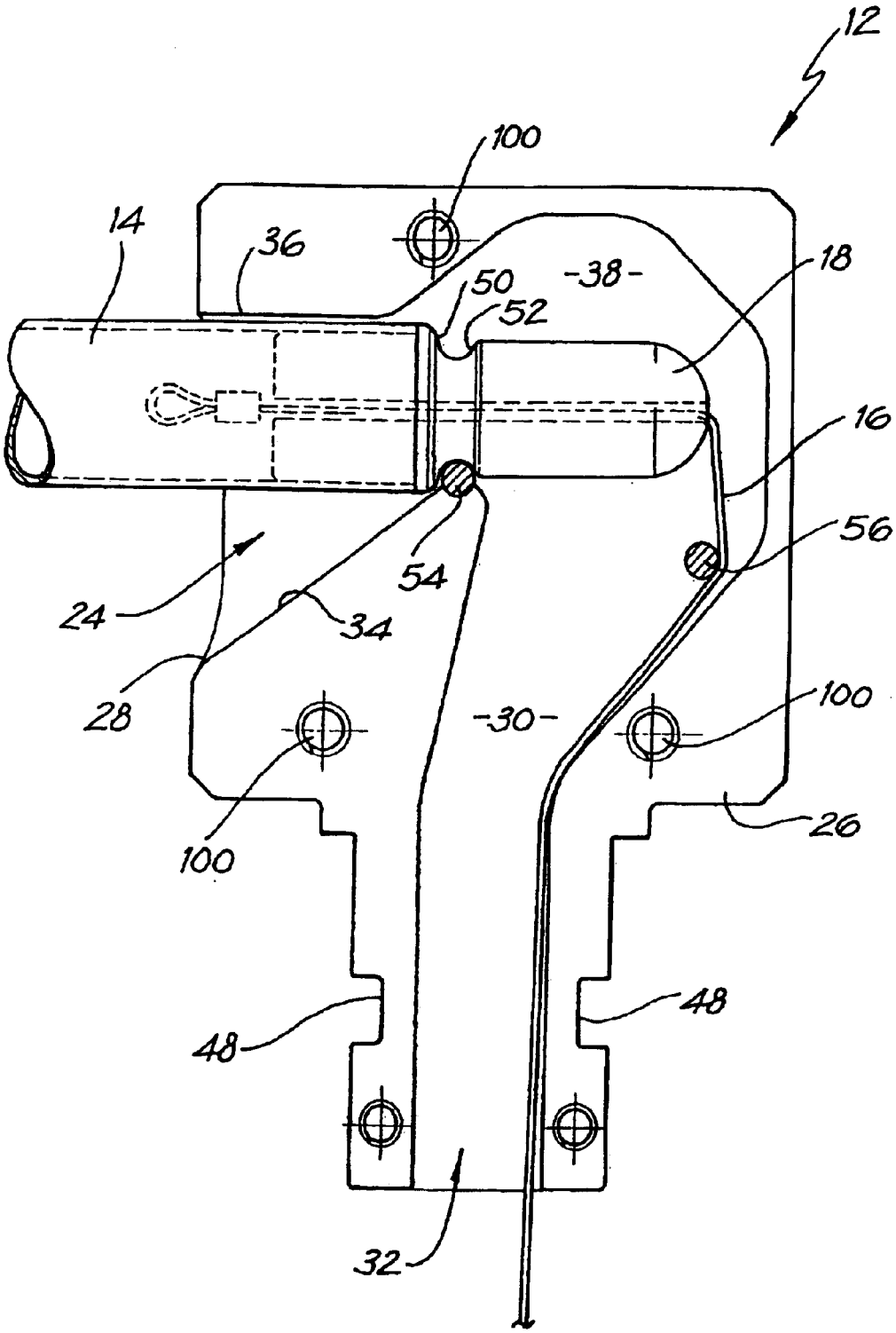
FIG. 2 shows a cross-sectional view of the housing of an apparatus in accordance with the present invention.
Figure 3:
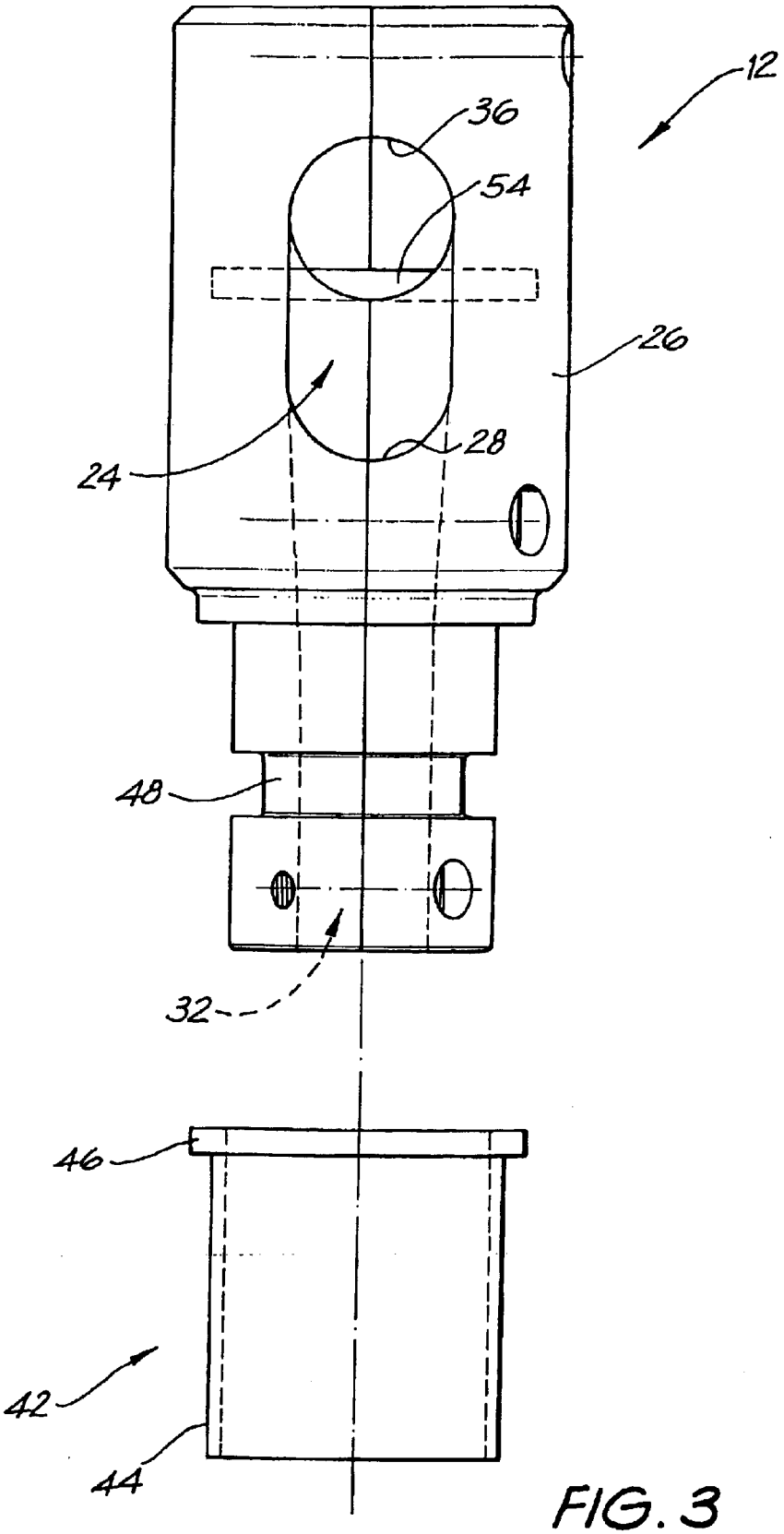
FIG. 3 shows an end view of the housing of FIG. 2.

Turning now to FIGS. 2 and 3, the apparatus 12 includes a housing 26. The housing 26 has an opening 24 in one side face thereof. The opening 24 has a lower edge 28.

The housing 26 also includes a passage 30 extending therethrough. The passage 30 opens at one end in opening 24 and opens at the other end at opening 32.

As best seen from FIG. 2, the passage 30 has a wall 34 that extends upwardly and inwardly from lower edge 28 of opening 24. The upper wall of passage located above lower wall 34 extends essentially horizontally or, in some embodiments, at a slight upwards angle to the horizontal. The upper wall is shown by reference numeral 36 in FIG. 2.

The passage 30 also includes a chamber 38 that is located above the position of the end 18 of arm 14 when arm 14 is held in its predetermined orientation. The reason for the passage having this shape will be explained in more detail hereunder.

The lower part of housing 26 includes a downwardly extending tubular member 40. Tubular member 40 may be formed integrally with the upper part of housing 26 or it may be formed as a separate part and a subsequently affixed to upper part of housing 26. Downwardly extending member 40 defines part of passage 30 of the housing.

As best shown in FIG. 3, the apparatus may further include a bush 42. Bush 42 includes a downwardly depending sleeve 44 that is sized to snugly fit within the inner diameter of hollow flagpole 10. The bush 42 also includes an upper flange 46, which upper flange rests on the upper part of flagpole 10. The inner diameter of bush 42 is sized such that it can snugly accept downwardly extending tubular member 40 of housing 26.

In use, bush 42 is permanently affixed to the upper part of flagpole 10, for example, by the use of screws, bolts or the like. The screws, bolts or the like preferably pass along a chord of the flagpole 10 such that they nestle in recesses 48 formed in the tubular member 40 of housing 26. In this manner, the screws, bolts or the like hold the housing 26 in position so that the housing 26 cannot be axially removed from the bush 42. However, housing 26 is still able to rotate within the bush 42.

It is preferred that the bush 42 is made from a self-lubricating polymeric material, such as Ertalon1fx. This is a polymeric material that incorporates graphite particles. The use of this material, or like materials, ensures that the housing 26 can freely rotate within the bush 42.

Figure 7:
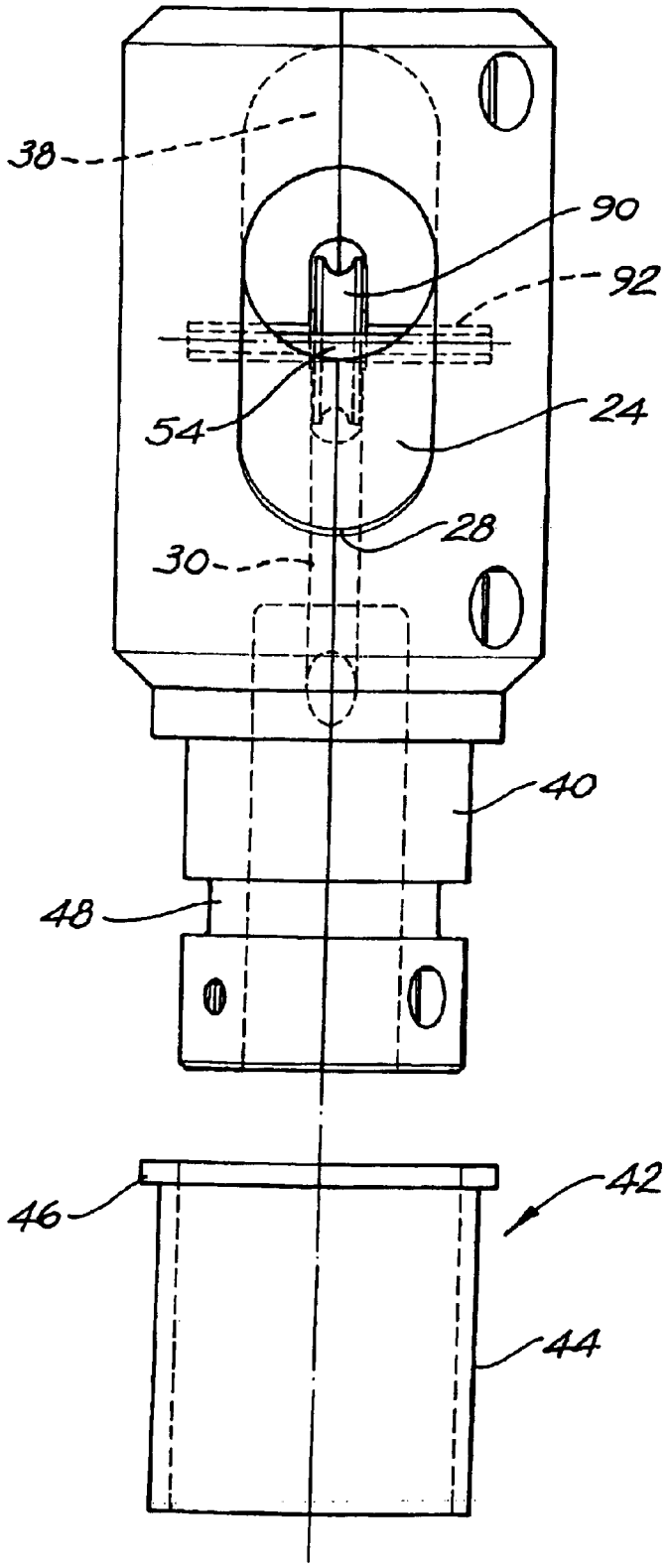
FIG. 7 shows an end view of the housing of FIG. 6 and its associated mounting bush.

The arm 14 has an end 18 to which the cable 16 is attached, or as shown in FIG. 7, from which the cable 16 extends. In the embodiment shown in FIG. 2 the cable 16 passes through an opening in the end 18 of arm 14 and is connected to the arm 14 internally of the arm. The arm 14 is provided with a first shoulder 50 and a second shoulder 52. Shoulders 50, 52 are located a short distance away from end 18 of am 14.

The housing 26 also includes a first rod 54 and a second rod 56 mounted within the housing. As best shown in FIG. 2, first rod 54 is sized such that it can be positioned within the neck portion defined between first shoulder 50 and second shoulder 52. Second rod 56 is positioned as shown in FIG. 2. Second rod 56 acts as a guide for the cable 16.

In use of the invention shown in FIGS. 1 to 3, the cable 16 is initially unwound such that arm 14 is positioned close to the level of the ground. The banner and flag are attached to the arm and the cable 16 is then wound up. This raises the arm upwardly until end 18 of arm 14 begins to enter opening 24 in the side face of housing 26. Continued retraction of the cable causes the end 18 of arm 14 to move into the housing and up along the wall 34. As mentioned earlier, wall 34 extends upwardly and inwardly from the lower edge 28 of opening 24. The wall 34 acts to guide the arm 14 as it is retracted into passage 30 of housing 26.

The arm 14 continues to be retracted into the passage 30 by continued retraction of the cable until the first shoulder 50 engages with first rod 54. Once the shoulder 50 engages with rod 54, the arm 14 cannot be further retracted into passage 30. However, continued force applied via retraction of cable 16 causes the arm 14 to pivot about the engagement between first shoulder 50 and first rod and first rod 54. As a result, end 18 of arm 14 rotates downwardly and the end of arm 14 that is extending out of opening 24 pivots upwardly. Pivoting of the arm 14 continues until the arm 14 comes into contact with upper wall 36 of the passage 30. At this time, second shoulder 52 is either in engagement with or in close abutment to first rod 54. This thereby prevents lateral motion of the arm 14. In other words, the arm 14 is effectively locked into position.

If the wind blows, the housing 26 may rotate in bush 42.

In order to remove or change a flag or banner firm arm 14, the cable 16 is unwound. As soon as the cable begins to unwind, the force of gravity causes the arm 14 to pivot about first rod 54. This pivotal motion results in end 18 of arm 14 moving upwardly. In order to accommodate this movement (and the similar movement when the arm 14 is retracted into passage 30) passage 30 is provided with chamber 38 above the end 18 as shown in FIG. 2.

Once the cable 16 has been unwound sufficiently such that am 14 comes into contact with wall 34, further unwinding of the cable 16 results in the arm 14 moving downwardly and out of the passage 30. The arm can then be lowered to the ground.

Figure 4:
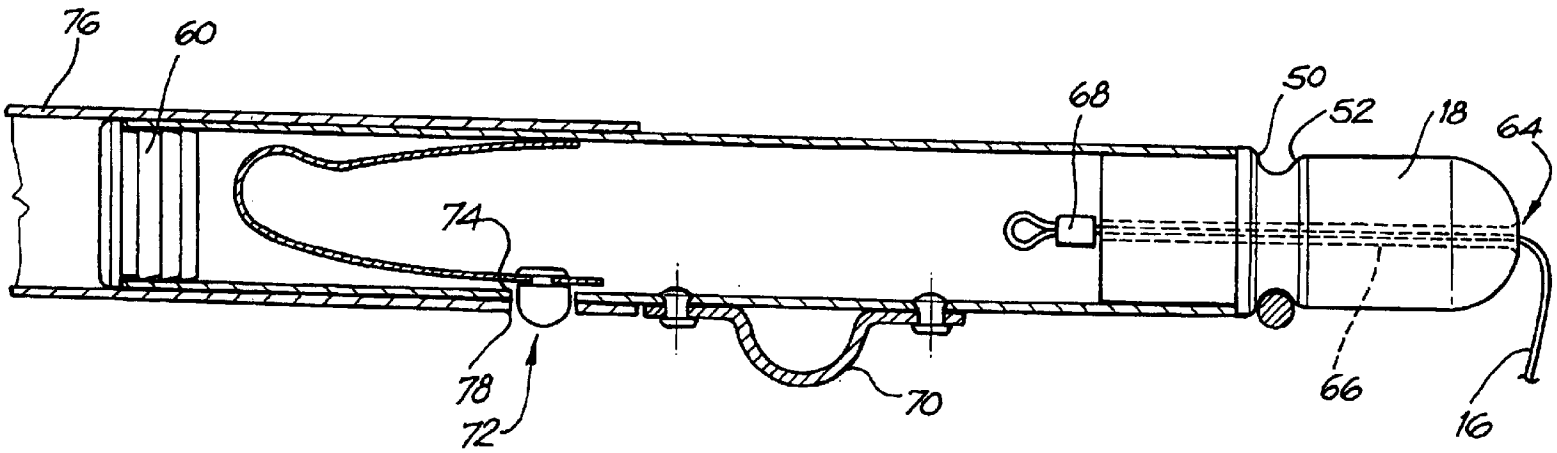
FIG. 4 shows an expanded view of the arm used in the apparatus of the present invention.

FIG. 4 shows the arm 14 in ether detail. In particular, FIG. 4 shows some constructional details of the arm 14 as well as the fitment of an optional extension arm thereto.

With reference to FIG. 4 the arm 14 comprises a hollow tube 58 having a cap 60 fitted into one end. The other end has plug 62 fitted thereto. Plug 62 defines the first and second shoulders 50, 52 as well as the end 18 of the arm 14. Plug 62 has an opening 64 and a passage 66 extending therethrough, which passage and opening are sized to be able to receive the cable 16. In order to affix the cable 16 to the plug 62, the cable 16 is passed through passage 66 until a length of cable 16 extends therefrom. A swaging element 68 is then used to lock the cable 16 in place.

Figure 14:
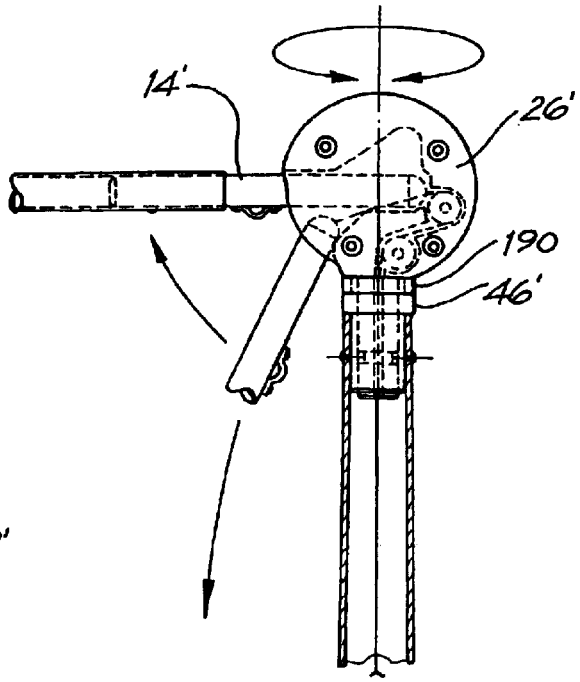
FIG. 14 shows a plan view of an upper bush used in conjunction with the apparatus of FIG. 11.
Figure 14:
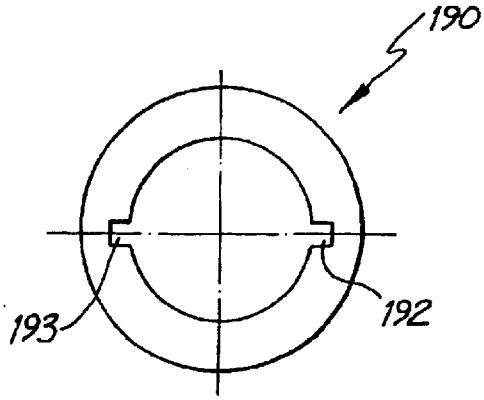

Although the end 18 of arm 14 shown in FIG. 14 comprises plug 62, it will be appreciated that end 18 may be integrally formed with the arm 14. Similarly, the cable 16 does not necessarily have to pass or extend into the arm 14. Indeed, the cable 16 may simply be attached to the end 18 of the arm 14.

In order to facilitate fitment of banners or flags to the arm 14, the arm may be provided with a stainless steel saddle 70. Stainless steel saddle 70 may suitably be screwed or welded to the arm 14.

The arm 14 is also provided with a button spring 72 which has a projection extending from a hole 74 in the arm 14. The button spring 72 enables easy fitment of an extension arm 76 to the arm 14. In particular, extension arm 76 is also provided with an opening 78 through which button spring 72 can fit when the opening 78 is positioned over the button spring 72. The button spring 72 may have an external profile that enables easy fitment.

The present invention enables especially convenient changing of flags, banners or the like, The apparatus enables the support arm for holding the flag to be securely positioned in a generally horizontal orientation. Engagement between the arm 14 and the upper wall 36 of the passage maintains the arm 14 in the horizontal orientation. Moreover, engagement between the first and second shoulders 50, 52 and the first rod 54 locks the arm 14 into a fixed lateral position.

The second rod 56 is positioned as shown in FIG. 2 in order to ensure that a suitable turning moment is applied by retraction of the cable once the first shoulder 50 contacts the first rod 54.

The embodiments shown in FIGS. 1 to 3 relate to a rotating finial that is positioned on top of a flagpole. However, it will be appreciated that the housing 26 may be mounted to an intermediate portion of a flagpole. In this arrangement, it is not necessary to have the downwardly extending tubular member 40 as part of the housing 26. Furthermore, it will be necessary to provide an opening in the outer surface of the flagpole that is generally coincident with the opening 24 in the side surface of the housing. It may also be appropriate to form the housing such that it is generally cylindrical in this embodiment so that it neatly fits inside cylindrical flagpoles. It will also be appreciated that similar apparatus may be integrally formed with the flagpole rather than having a separate housing that is mounted to the flagpole. However, the use of a separate housing has the advantage that it can be retrofitted to existing flagpoles.

Figure 5:
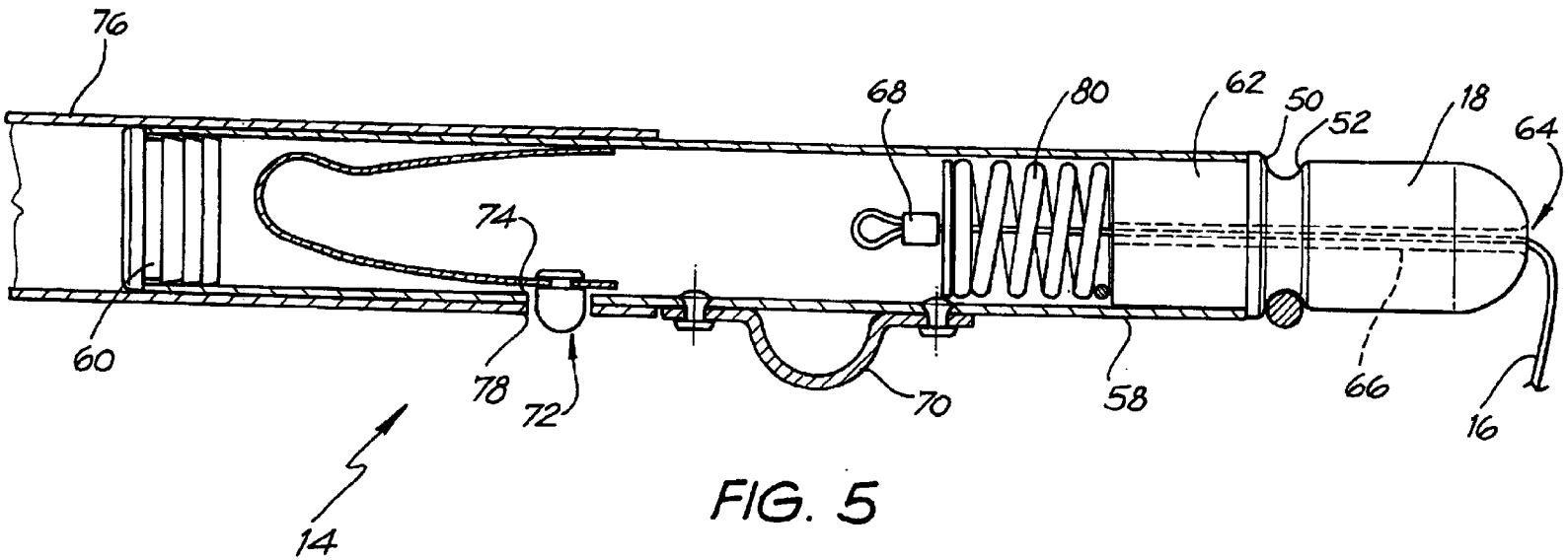
FIG. 5 shows a cross-sectional view of an alternative arm construction for use in the present invention.

FIG. 5 shows a cross-sectional view of an alternative arm construction. The arm of FIG. 5 has a generally similar construction to the arm of FIG. 4 and like features in FIG. 5 have been given the same reference numeral as the equivalent features in FIG. 4. Those feature need not be discussed further.

The arm of FIG. 5 differs from that in FIG. 4 in that a compression spring 80 is fitted to abut against end 82 of plug 62. A washer 84 is placed against the opposite end of compression spring 80 and, in conjunction with swaging element 68 assists in holding the cable in place.

The use of the compression spring 84 in the arm of FIG. 5 assists in lowering impact forces caused by retracting the cable, thereby potentially increasing the useful life of the arm.

Figure 6:
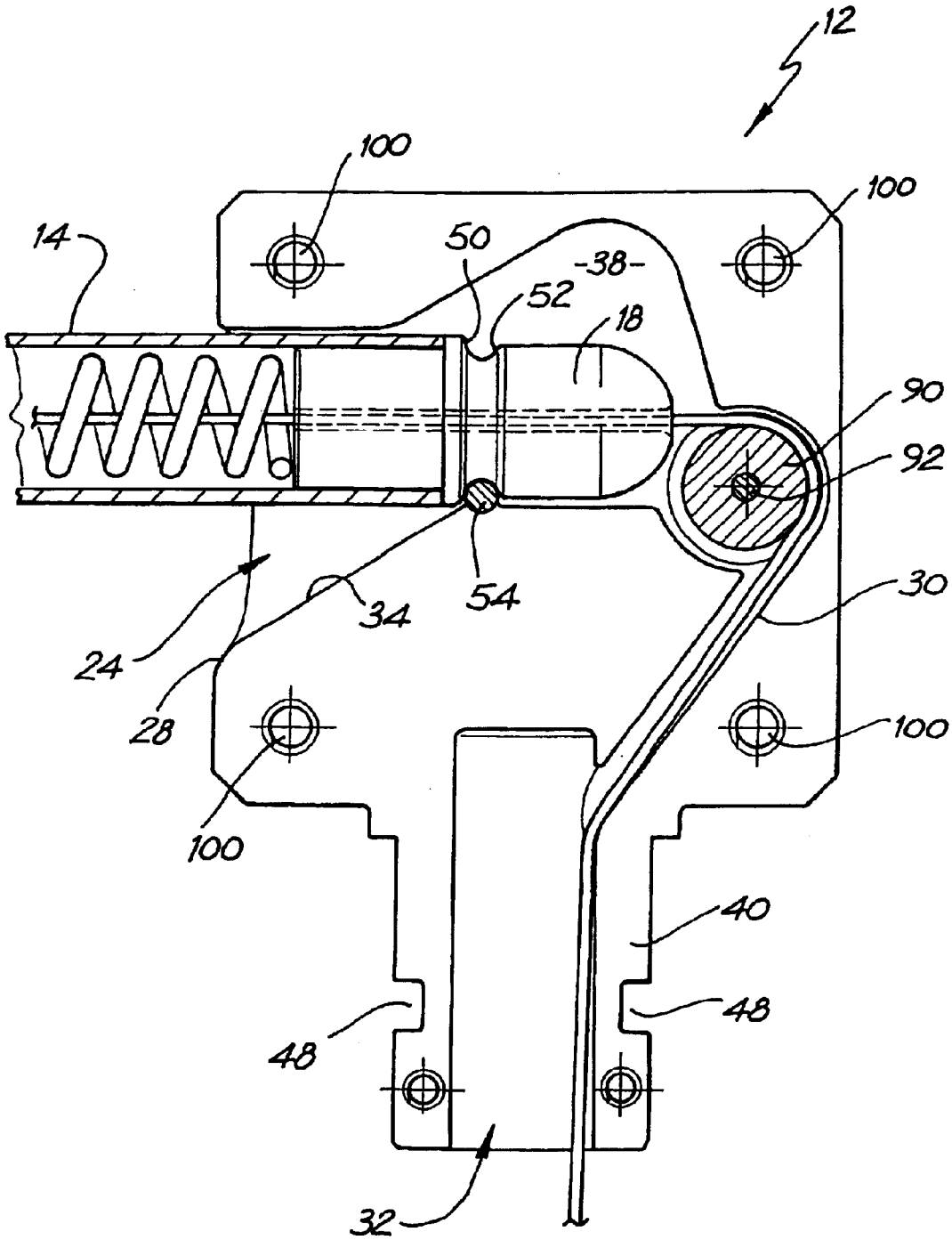
FIG. 6 shows a cross-sectional end view of a housing in accordance with another embodiment of the present invention.

FIGS. 6 and 7 show a housing and apparatus that is generally similar to that shown in FIGS. 2 and 3. Features in FIGS. 6 and 7 that are common with features in FIGS. 2 and 3 have been given the same reference numerals as those in FIGS. 2 and 3 and need not be described further.

The main difference between the embodiment of FIGS. 2 and 3 and the embodiment of FIGS. 6 and 7 is that the embodiment of FIGS. 6 and 7 includes a rotatable guide wheel 90 mounted on a pin or axle 92 to guide the cable 16. The guide wheel 90 replaces the second rod 56 and acts to reduce friction on the cable 16 during retraction or extension of the cable 16.

Figure 8:
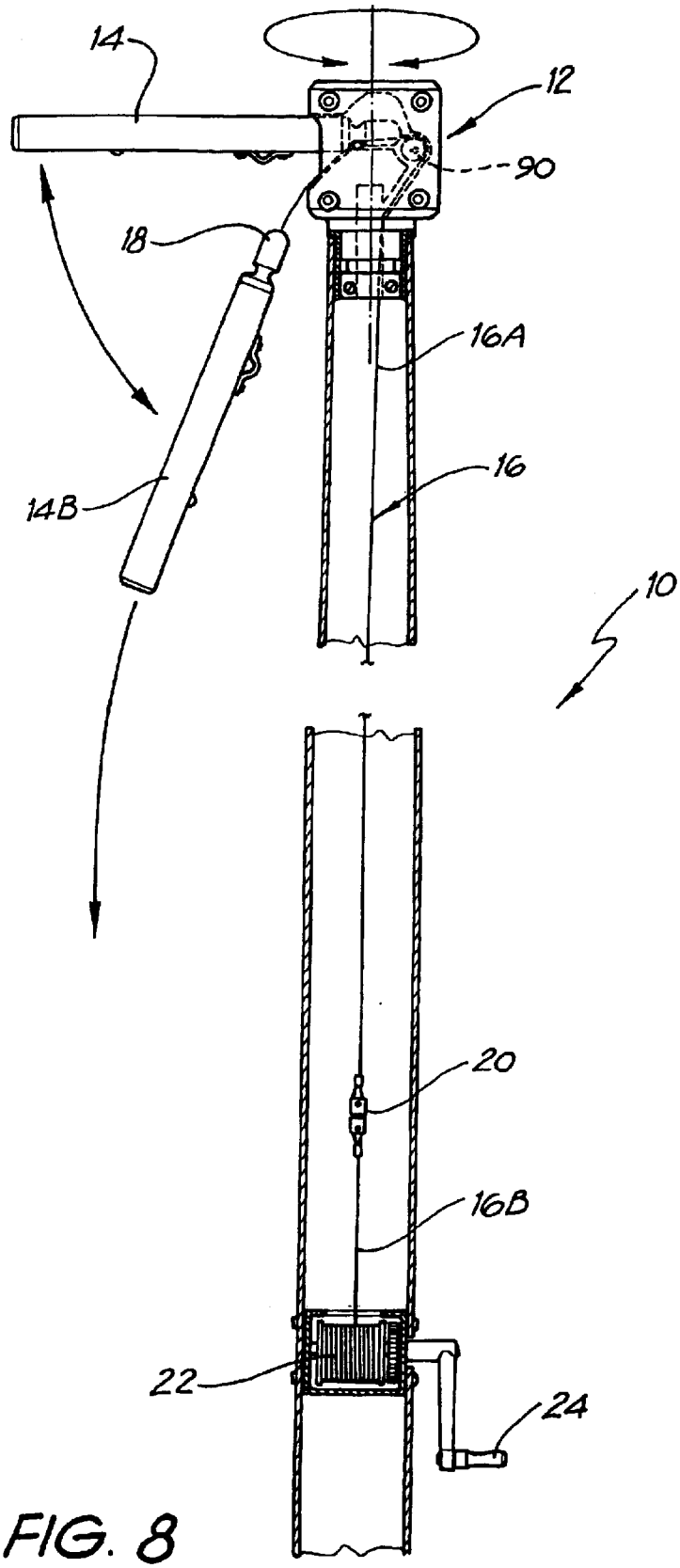
FIG. 8 shows a cross-sectional view of the apparatus of FIGS. 6 and 7 attached to the top of a flagpole.

FIG. 8 shows the apparatus of FIGS. 6 and 7 mounted to a flagpole. The features of FIG. 8 are similar to those of FIG. 1 and like reference numerals have been used on both Figures. The description of FIG. 1 is equally applicable to FIG. 8 and further description of FIG. 8 is not required.

The housing of FIGS. 2 and 3 or 6 and 7 may be made from two separate pieces mat are joined together by screws or other suitable fasteners. Screw holes 100 may be provided for that purpose.

Figure 9:
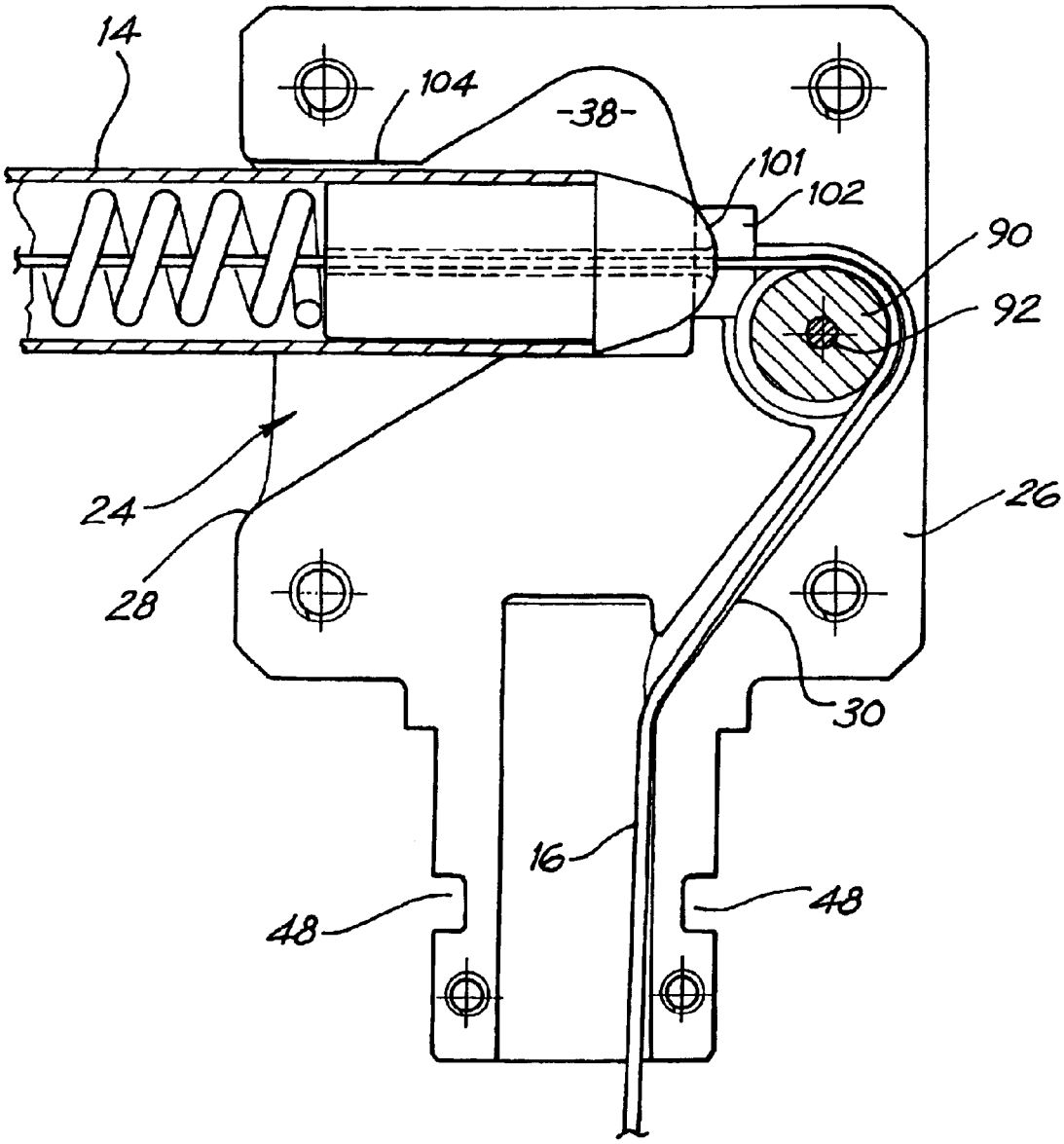
FIG. 9 shows a side view, partly in cross-section, of a further embodiment of the present invention; an FIG. 10 shows an end view of the apparatus of FIG. 9
Figure 10:
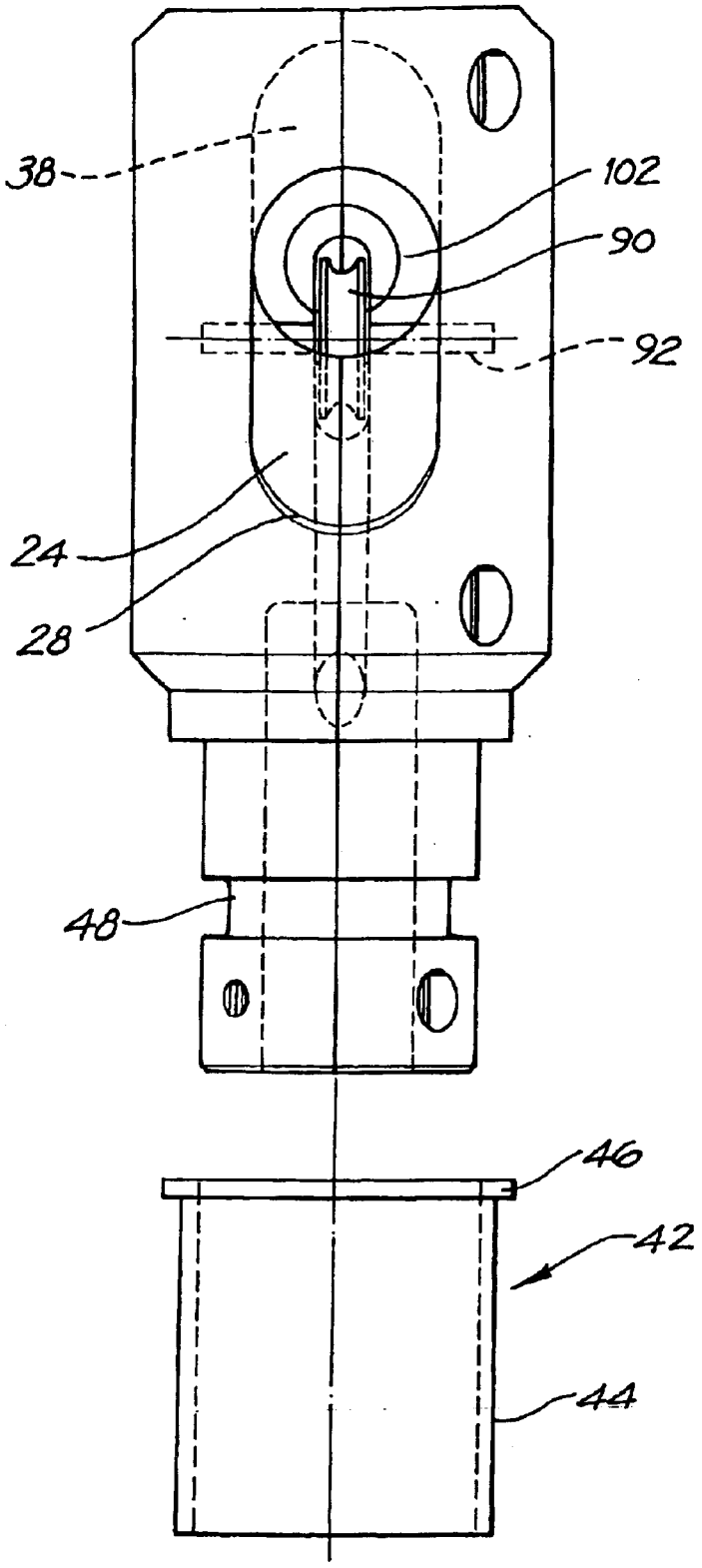

FIGS. 9 and 10 shows another embodiment of the present invention. In FIGS. 9 and 10, features that are common with the embodiment of FIGS. 1 to 4 or with the embodiment of FIGS. 5 to 8 are denoted by the same reference numeral.

In the embodiment of FIGS. 9 and 10, the arm 14 is not provided with shoulders 50, 52, as shown in FIGS. 1 to 8. Housing 26 also does not have pin 54.

In the embodiment of FIGS. 9 and 10, arm 14 has an essentially cylindrical side surface and a curved or rounded end 101. When the cable 16 is fully retracted, end 101 extends into chamber extension 102. Tension on cable 16 and contact between the side wall of arm 14 and top 104 of passage 30 results in the arm 14 being held in place. The arm can be lowered in a similar fashion to that described for the embodiments of FIGS. 1 to 8.

FIGS. 11 to 16 who a further embodiment of the present invention. A number of the features of the embodiment shown in FIGS. 11 to 16 are common to the embodiments shown in FIGS. 1 to 10. For convenience, like features in FIGS. 11 to 16 will be denoted by the same reference numberal as used for the corresponding features in FIGS. 1 to 10, but with the addition of a prime (')

The apparatus 12' of FIGS. 11 to 16 includes a housing 26'. The housing 26' has an opening 24' in one side face thereof. The opening 24' has a lower edge 28'. The housing 26' also includes a passage 30' extending therethrough. The passage 30' opens at one end in opening 24' and opens at the other end at opening 32'.

Figure 12:
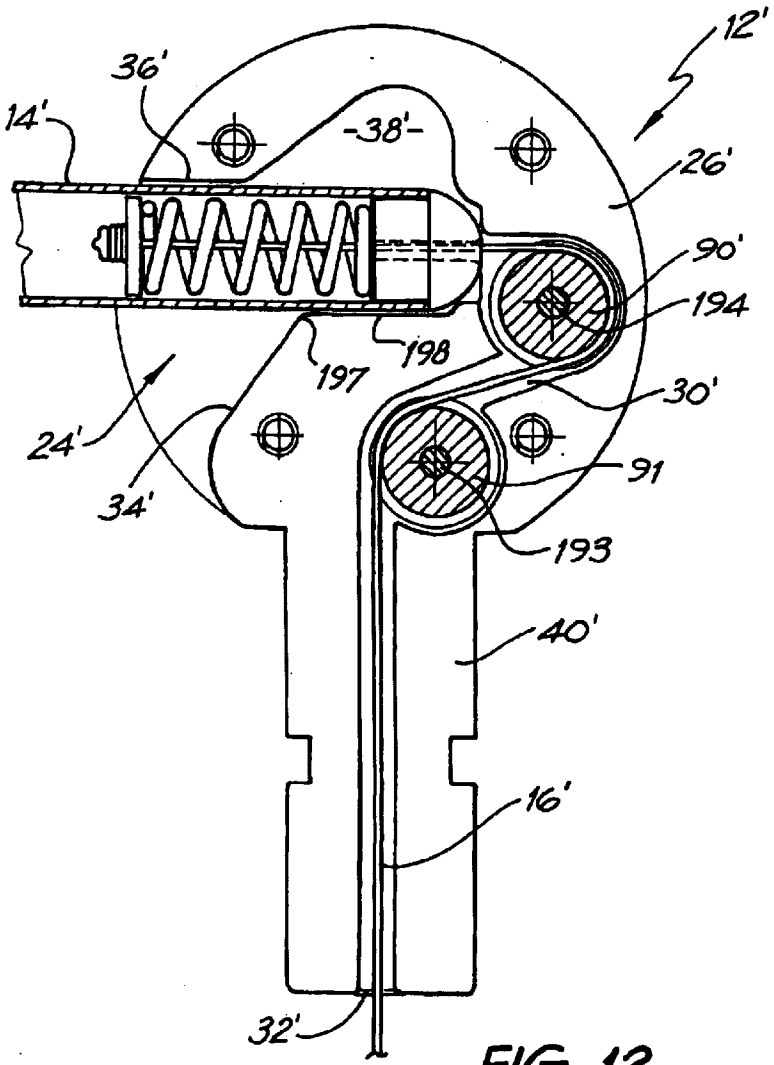
FIG. 12 shows a side view, partly in cross-section, of the apparatus of FIG. 11.
Figure 11:
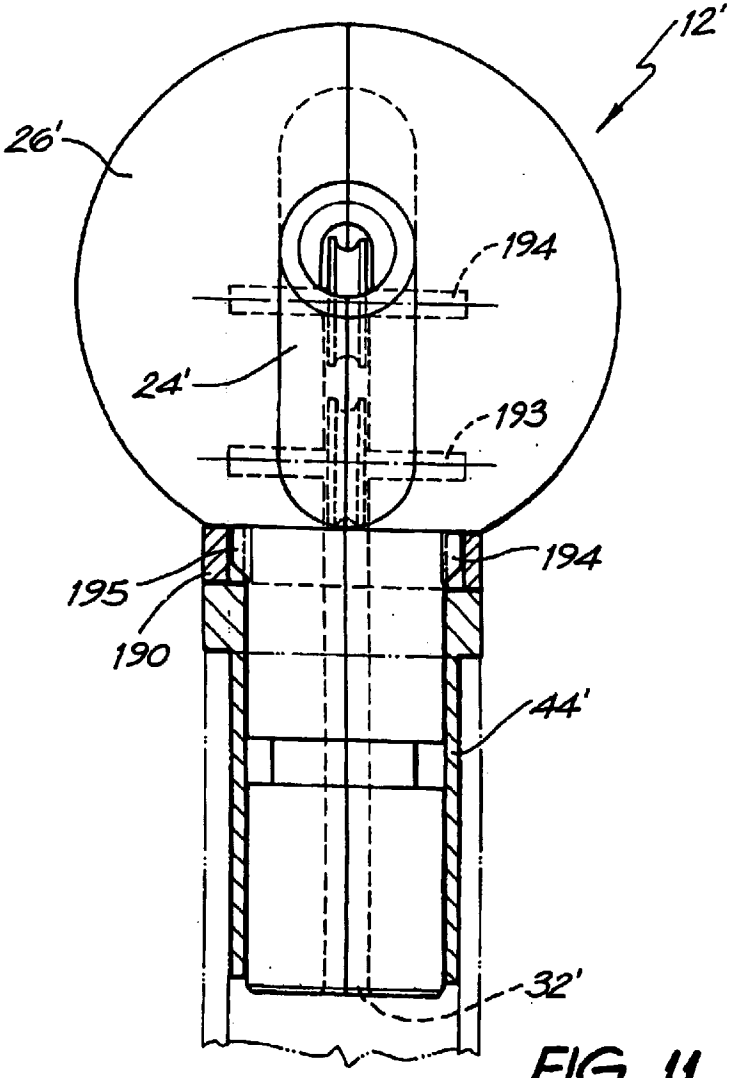
FIG. 11 shows an end view, partly in cross-section, of an apparatus in accordance with another embodiment of the present invention.

As best seen from FIG. 12, the passage 24' has a wall 34' that extends upwardly and inwardly from a lower part of opening 24'. The upper wall of passage located above lower wall 34' extends essentially horizontally or, in some embodiments, at a slight upwards angle to the horizontal. The upper wall is shown by reference numeral 36' in FIG. 12.

The passage 30' also includes a chamber 38' that is located above the position of the end 18' of arm 14' when arm 14' is hold in its predetermined orientation.

The lower part of housing 26' includes a downwardly extending tubular member 40'. Tubular member 40' may be formed integrally with the upper part of housing 26' or it may be formed as a separate pat and a subsequently affixed to upper part of housing 26'. Downwardly extending member 40' defines part of passage 30' of the housing.

Figure 13:
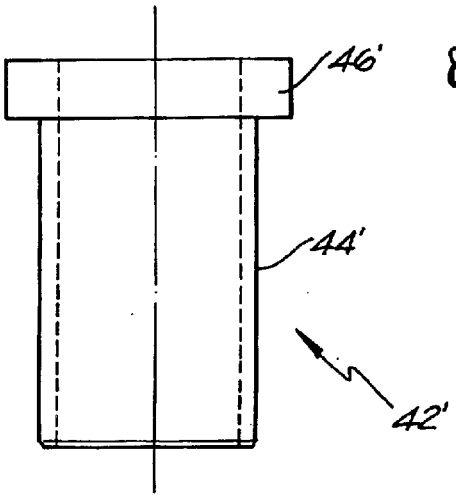
FIG. 13 shows a side view of a lower bush used in conjunction with the apparatus of FIG. 11.

The apparatus further include a lower bush 42' (FIG. 13). Bush 42' includes a downwardly depending sleeve 44' that is sized to snugly fit within the inner diameter of hollow flagpole 10'. The bush 42' also includes an upper flange 46', which upper flange rests on the upper part of flagpole 10'. The inner diameter of bush 42' is sized such that it can snugly accept downwardly extending tubular member 40' of housing 26'.

Th apparatus further includes an upper bush 190 tat has a passage 191 sized to snugly receive the tubular member 40'. Upper bush 190 includes opposed keyways 192, 193 that receive projections 194, 195 that are formed on the side of the upper part of tubular member 40'. In use, if the apparatus 12' rotates, foe example, as caused by wind blowing a flag, the upper bush 190 rotates on the upper flange 46' of lower bush 40'. The frictional forces acting on the apparatus can be reduced by manufacturing the upper and lower bushes from suitable plastics materials, especially from a self-lubricating polymer. It will be appreciated that the mounting of the apparatus 12' to the flagpole 10' is essentially identical to the mounting of the apparatus 12 to the flagpole 10, as described with reference to FIGS. 1–10, except for the inclusion of upper bush 190.

Figure 15:
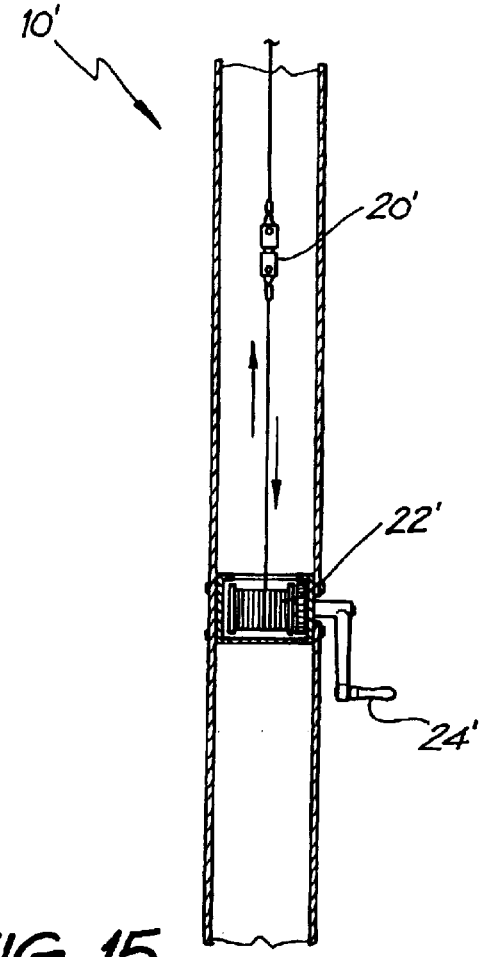
FIG. 15 is a side view, partly in cross-section, of the apparatus of FIGS. 11 to 14 mounted to a flagpole.
Figure 16:
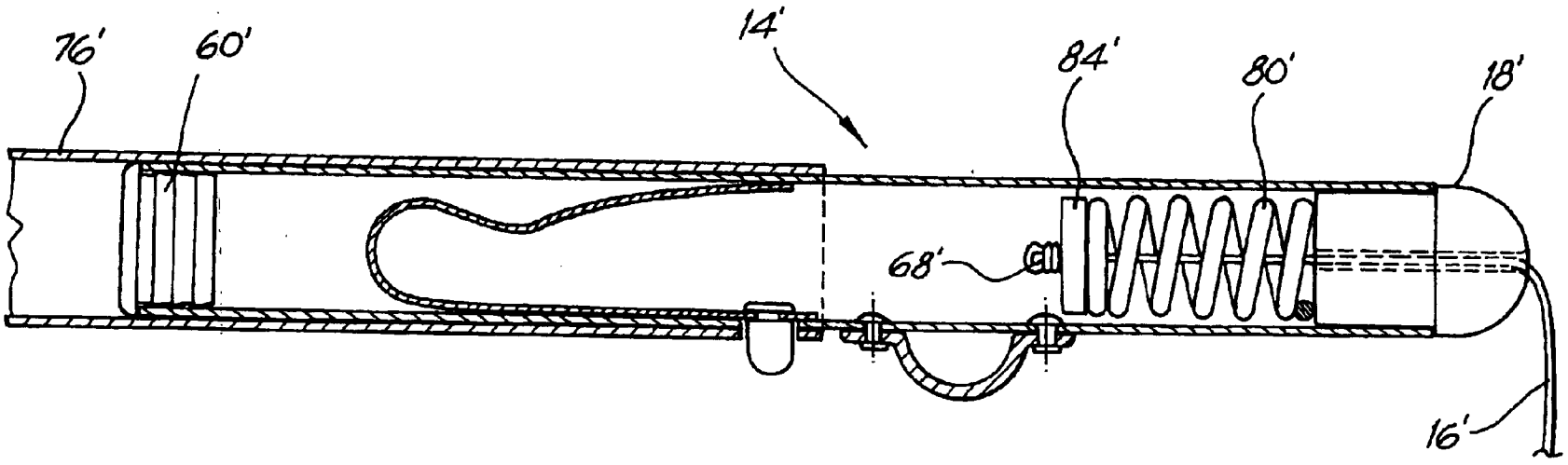
FIG. 16 shows a side view, partly in cross-section, of an arm for use with the apparatus shown in FIGS. 11 to 15.

The arm 14' has an end 18' to which the cable 16' is attached, or as shown in FIG. 15, from which the cable 16' extends. In the embodiment shown in FIG. 15 the cable 16' passes through an opening in the end 18' of arm 14' and is connected to the arm 14' internally of the arm. Unlike the arm 14 of FIG. 4, the arm 14' is not provided with first and second shoulders.

The housing 26' also includes a first rotating wheel 90' which acts as a guide for the cable 16. A second rotating wheel 91 is alos provided to assist in guiding the cable 16' and ensure that the cable 16' does not rub on the inner wall of passage 30'. Wheels 90' and 91 are mounted on respective axles 193,194.

In use of the invention shown in FIGS. 11 to 16, the cable 16' is initially unwound such that arm 14' is positioned close to the level of the ground. The banner or flag is attached to the arm and the cable 16' is then wound up. This raises the arm upwardly until end 18' of arm 14' begins to enter opening 24' in the side face of housing 26'. Continued retraction of the cable causes the end 18' of arm 14' to move into the housing and up along the wall 34'. As mentioned earlier, wall 34' extends upwardly and inwardly from the lower portion of opening 24'. The wall 34' acts to guide the arm 14' as it is retracted into passage 30' of housing 26'.

The arm 14' continues to be retracted into the passage 30' by continued reaction of the cable. Eventually, the arm 14' pivots on point 197 where wall 34' meets horizontal lower wall 198. As a result, end 18' of arm 14' rotates downwardly and the end of arm 14' that is extending out of opening 24' pivots upwardly. Pivoting of the arm 14' continues until the arm 14' comes into contact with upper wall 36' of the passage 30'. The arm is held in place against movement out of opening 24' by the tension applied to cable 16'.

Those skilled in the art will appreciate that the invention described herein may be susceptible to variations and modifications other than those specifically described. It will be appreciated that the invention encompasses all such variations and modifications that fall within its spirit and scope.

We claim:

1. An apparatus for supporting flags or banners comprising a housing for mounting to a hollow pole, said housing having a passage therethrough, a cable means extending through said passage, an arm for attaching flags or banners thereto, said cable means being attached to said arm, wherein retraction of the cable means causes the arm to be retracted into the housing and to be positioned in a predetermined orientation in which said flag or banner is displayed, said housing having a chamber, said chamber defining a space above an end portion of the arm when the cable means is fully retracted and said arm is in said predetermined position, said chamber being sized such that said end portion of the arm enters the space during retraction of the arm into the predetermined position and during release of the arm from the predetermined position.

2. An apparatus as claimed in claim 1 wherein said passage extends from an opening in a side face of the said housing and said passage includes a sloping wall that extends upwardly and inwardly from a lower edge of said opening into said housing, said arm moving along said sloping wall during retraction of said arm.

3. An apparatus as claimed in claim 1 further including a downwardly extending member for insertion into an upper end of the hollow pole.

4. An apparatus as claimed in claim 3 further comprising a bush, said bush being insertable into an upper part of said hollow pole, said bush receiving said downwardly extending member.

5. An apparatus as claimed in claim 4 wherein said bush comprises a downwardly depending sleeve that is sized to snugly fit within an inner diameter of a hollow flagpole, the bush further including an upper flange which rests on an upper part of the flagpole, an inner diameter of said bush being sized such that it can snugly accept said downwardly extending member wherein in us, bush is permanently affixed to the upper part of the hollow pole and said tubular member is mounted in the bush such that it is rotatable but cannot be removed from the bush.

6. An apparatus as claimed in claim 5 wherein said bush is mounted to the hollow pole by fastening means that pass along one or more chords of the flagpole and the fastening means nestle in recesses formed in the tubular member such that the fastening means hold the housing in position so that the housing cannot be axially removed from the bush but the housing is rotatable within the bush.

7. An apparatus as claimed in claim 1 wherein said cable means is attached to said arm via a spring means.

8. An apparatus as claimed in claim 1 wherein said arm has first shoulder positioned close to but away from an end thereof, the apparatus further including an engagement means positioned in said passage such that when said arm is retracted into the housing said first shoulder contacts said engagement means to prevent further inward movement of said arm and wherein continued retraction of said cable means causes said arm to pivot about said engagement means into the predetermined position.

9. An apparatus as claimed in claim 8 wherein said engagement means comprises a first rod in the housing.

10. An apparatus as claimed in 9 wherein the arm has a second should opposed to the first shoulder wherein when the arm is in the predetermined orientation, the first and second shoulders are positioned on opposite sides of said engagement means to thereby lock the arm against lateral movement when said arm is in the predetermined orientation.

11. An apparatus as claimed in claim 10 wherein the opposed first and second shoulders define a neck region extending around a periphery of the arm.

12. An apparatus as claimed in claim 1 wherein the housing further includes guide means around which the cable means passes.

13. An apparatus as claimed in claim 1 wherein the predetermined orientation is generally horizontal or wherein the arm extends slightly upwardly when in the predetermined orientation.

14. An apparatus as claimed in claim 1 further comprising a winch for retracting and extending the cable means.

15. Apparatus as claimed in claim 1 wherein the cable means includes a swivel joint.

16. A flagpole for supporting flags or banners comprising a hollow pole, a housing mounted to the hollow pole, said housing having a passage therethrough, a cable means extending through said passage, an arm for attaching a flag or banner thereto, said cable means being attached to said arm such that an end of said cable means terminates at a point of attachment to said arm, a winch for retracting and releasing said cable means, said winch being mounted to said hollow pole at a position located remote from the housing, wherein retraction of the cable means causes said arm to be retracted into the housing and to be positioned in a predetermined orientation in which the arm is generally horizontal or extends slightly upwardly from horizontal, characterized in that said winch is operable by an operator from ground level, that the cable means is located completely within the pole or completely within the pole and the arm when the cable means is in a fully retracted position and that the cable means is of a length that allows the arm to be lowered to a level to enable a flag or banner to the attached to the arm by an operator at ground level when the cable means is extended.

17. A flagpole as claimed in claim 16 wherein, said housing has a chamber, said chamber defining a space above an end portion of the arm when the cable means is fully retracted and said arm is in said predetermined position, said chamber being sized such that said end portion of the arm enters the space during retraction of the arm into the predetermined position and during release of the arm from the predetermined position.

18. A flagpole as claimed in claim 17 wherein said passage extends from an opening in a side face of the said housing and said passage includes a sloping wall that extends upwardly and inwardly from a lower edge of said opening into said housing, said arm moving along said sloping wall during retraction of said arm.

19. A flagpole as claimed in claim 16 wherein the housing has a downwardly extending member for insertion into an upper end of the hollow pole.

20. An apparatus as claimed in claim 19 further comprising a bush, said bush being insertable into an upper part of said hollow pole, said bush receiving said downwardly extending member.

21. A flagpole as claimed in claim 20 wherein said bush comprises a downwardly depending sleeve that is sized to snugly fit within an inner diameter of a hollow flagpole, the bush further including an upper flange which rests on an upper part of the flagpole, an inner diameter of said bush being sized such that it can snugly accept said downwardly extending member wherein in use, said bush is permanently affixed to the upper part of the hollow pole and said tubular member is mounted in the bush such that it is rotatable but cannot be removed from the bush.

22. A flagpole as claimed in claim 21 wherein said bush is mounted to the hollow pole by fastening means that pass along one or more chords of the flagpole and the fastening means nestle in recesses formed in the tubular member such that the fastening means hold the housing in position so that the housing cannot be axially removed from the bush but the housing is rotatable within the bush.

23. A flagpole as claimed in claim 16 wherein said cable means is attached to said arm via a spring means.

24. A flagpole as claimed in claim 16 wherein the cable means includes a swivel joint located between the housing and the winch.

25. A flagpole for supporting flags or banners comprising a hollow pole, a housing mounted to the hollow pole, said housing having a passage therethrough, a cable means extending through said passage, an arm for attaching flags or banners thereto, said cable means being attached to said arm, wherein retraction of the cable means causes the arm to be retracted into the housing and to be positioned in a predetermined orientation in which said flag or banner is displayed, said housing having a chamber, said chamber defining a space above an end portion of the arm when the cable means is fully retracted and said arm is in said predetermined position, said chamber being sized such that said end portion of the arm enters the space during retraction of the arm into the predetermined position and during release of the arm from the predetermined position.

26. A flagpole as claimed in claim 25 wherein said passage extends from an opening in a side face of the said housing and said passage includes a sloping wall that extends upwardly and inwardly from a lower edge of said opening into said housing, said arm moving along said sloping wall during retraction of said arm.

27. A flagpole as claimed in claim 25 further comprising a winch mounted to the hollow pole, said winch being located remote from the housing and at a position wherein said winch is operable by an operator at ground level and said cable means is sufficiently long to enable said arm to be lowered to a level to enable a flag or banner to be attached to the arm by an operator at ground level.

28. A flagpole as claimed in claim 25 wherein the housing is rotatable relative to the pole and the cable means includes a swivel joint.

* * * * *